US010739703B2

(12) United States Patent
Tanaka

(10) Patent No.: US 10,739,703 B2
(45) Date of Patent: Aug. 11, 2020

(54) DEVELOPING APPARATUS HAVING MAGNETIC FIELD GENERATING PORTION

(71) Applicant: CANON KABUSHIKI KAISHA, Tokyo (JP)

(72) Inventor: Chihiro Tanaka, Noda (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/520,835

(22) Filed: Jul. 24, 2019

(65) Prior Publication Data

US 2020/0064756 A1 Feb. 27, 2020

(30) Foreign Application Priority Data

Aug. 23, 2018 (JP) ..... 2018-156344

(51) Int. Cl.
*G03G 15/09* (2006.01)
*G03G 15/01* (2006.01)

(52) U.S. Cl.
CPC ..... *G03G 15/0921* (2013.01); *G03G 15/0121* (2013.01)

(58) Field of Classification Search
CPC ..... G03G 15/0921; G03G 15/0942; G03G 15/0121
See application file for complete search history.

(56) References Cited

U.S. PATENT DOCUMENTS

2013/0129376 A1* 5/2013 Noguchi ..... G03G 15/09 399/104
2016/0091830 A1* 3/2016 Furukawa ..... G03G 15/0921 399/104
2017/0068188 A1* 3/2017 Akita ..... G03G 15/0942

FOREIGN PATENT DOCUMENTS

JP 03-004266 A 1/1991
JP 10-240013 A 9/1998
JP 11-052731 A 2/1999
JP 2000-206791 A 7/2000

* cited by examiner

*Primary Examiner* — Sophia S Chen
(74) *Attorney, Agent, or Firm* — Venable LLP

(57) ABSTRACT

A developing apparatus includes a developer rotary member, a magnetic field generating portion, and a magnet portion. If an area of the magnet portion on an inner side from the end portion of the magnetic field generating portion with respect to the rotational axis direction of the developer rotary member is defined a first magnet area and an area of the magnet portion on an outer side from the end portion with respect to the rotational axis direction is defined a second magnet area, an average value of a component, in a normal direction of the developer rotary member, of a magnetic flux density of the magnet portion in the second magnet area is greater than an average value of a component, in a normal direction of the developer rotary member, of a magnetic flux density of the magnet portion in the first magnet area by 100 gauss or more.

8 Claims, 8 Drawing Sheets

DEVELOPING APPARATUS HAVING MAGNETIC FIELD GENERATING PORTION

BACKGROUND OF THE INVENTION

Field of the Invention

The present invention relates to a developing apparatus adopted in an image forming apparatus such as a copying machine or a printer that forms an image on a recording material using an electrophotographic system or an electrostatic recording system.

Description of the Related Art

Hitherto, image forming apparatuses adopting an electrophotographic system are used widely in copying machines, printers, plotters, facsimiles, and multifunction devices having a plurality of such functions. Generally, the developing apparatus equipped in the image forming apparatus adopting an electrophotographic system or an electrostatic recording system utilizes either a one-component developer containing magnetic toner as main component or a two-component developer containing nonmagnetic toner and magnetic carrier as main components. Specifically, in an image forming apparatus that forms a full-color or multi-color image by electrophotographic system, the two-component developer is mainly used from the viewpoint of image tone. Developer in the developing apparatus is transmitted from one end portion to the other end portion of a developing sleeve in a rotational axis direction along the surface of the developing sleeve by being moved in circulation in the developing apparatus.

The developing sleeve has a magnet roller serving as a magnetic field generating portion built therein. The magnet roller has multiple magnet poles arranged along a rotation direction of the developing sleeve, and since only very little magnetic force is generated in a release area formed by an N3 pole and an N2 pole among the multiple magnetic poles, developer can be released from the developing sleeve and returned to a developer container. Since only very small magnetic force is generated at the release area, developer will be transferred in the rotational axis direction without being borne on the developing sleeve, and there is a risk of leakage of developer from an end portion of the developing sleeve or developer being scattered.

In order to suppress scattering of developer from the end portion of the developing sleeve, a developing apparatus equipped with a magnetic seal member for providing a magnetic seal by a magnetic seal generating portion has been proposed (refer to Japanese Patent Application Laid-Open Publication No. 3-004266). In the developing apparatus, the magnetic seal member has an opposing surface that is magnetized and arranged to oppose to a surface of the developing sleeve at a predetermined distance from the surface, and developer is magnetically attracted and maintained by the magnetic seal member. Since the magnetic seal member is not in contact with the developing sleeve, rotation load of the developing sleeve is reduced and degradation caused by abrasion is not generated, so that it has an advantage of long life. If a plate-shaped magnet is provided as a magnetic seal member in a manner surrounding the developing sleeve in a noncontact manner, a magnetic brush is formed by developer between the magnet roller inside the developing sleeve and the magnetic seal member, and leakage of toner can be suppressed. Further, in the release area of the magnet roller, the magnetic pole on the surface of the magnetic seal member facing the developing sleeve is set to S pole, so that opposite polarities face each other. Thereby, lines of magnetic force are connected between the magnet roller and the magnetic seal member, and a higher sealing performance is realized.

Recently, in image forming apparatuses, rotational speed of the photosensitive drum is accelerated, and along with the photosensitive drum that is rotated at high speed, the rotational speed of the developing speed is also accelerated to realize sufficient developing efficiency, causing toner to be scattered easily. In contrast, according to the developing apparatus disclosed in the above-described Japanese Patent Application Laid-Open Publication No. 3-004266, the gap between the developing sleeve and the magnetic seal member may be narrowed to increase the sealing performance so as to prevent toner scattering caused by acceleration. Thereby, lines of magnetic flux are concentrated between the developing sleeve and the magnetic seal member, and toner scattering can be suppressed.

However, according to the developing apparatus, the gap between the developing sleeve and the magnetic seal member is narrowed, so that developer is easily clogged between the developing sleeve and the magnetic seal member, and the clogged developer may apply a large load on the developer. If the load applied from the clogged developer to the developing sleeve is increased, toner may melt and adhere to the developing sleeve or the developing sleeve may be locked. Therefore, in order to cope with the increase in rotational speed of the photosensitive drum, both scattering of toner and adhesion of toner must be suppressed.

The present invention provides a developing apparatus having a magnetic member for sealing provided at the end portion of the developing sleeve, capable of suppressing both toner scattering from the developing sleeve and melting and adhesion of toner to the developing sleeve.

SUMMARY OF THE INVENTION

According to a first aspect of the present invention, a developing apparatus includes a developer rotary member configured to bear and convey developer containing toner and carrier toward a position where an electrostatic image formed on an image bearing member is developed, a magnetic field generating portion arranged to be fixed inside the developer rotary member, comprising a first magnetic pole and a second magnetic pole arranged adjacent to the first magnetic pole downstream of the first magnetic pole with respect to a rotating direction of the developer rotary member and having a same polarity as the first magnetic pole, and configured to generate a magnetic field to release developer, having passed the position where the electrostatic image formed on the image bearing member is developed, from an outer peripheral surface of the developer rotary member, and a magnet portion arranged to oppose to the outer peripheral surface of the developer rotary member at a position downstream of a peak position where a component, in a normal direction of the developer rotary member, of a magnetic flux density of the first magnetic pole becomes maximum and upstream of a peak position where a component, in a normal direction of the developer rotary member, of a magnetic flux density of the second magnetic pole becomes maximum with respect to the rotating direction of the developer rotary member, the magnet portion arranged to be overlapped with an area in which a component, in a normal direction of the developer rotary member, of a magnetic flux density reduces from an end portion of a maximum image area capable of forming an image on the image bearing member toward an outer side with respect to a rotational axis direction of the developer rotary member. A magnetic pole of a surface, on a side opposed to the outer peripheral surface of the developer rotary member in a radial direction of the developer rotary member, of the magnet portion has opposite polarity as the first magnetic pole. The magnet portion is overlapped with an end portion of the magnetic field generating portion with respect to the rotational axis direction of the developer rotary member. In a case where an area of the magnet portion on an inner side from the end portion of the magnetic field generating portion with respect to the rotational axis direction of the developer rotary member is defined a first magnet area and an area of the magnet portion on an outer side from the end portion of the magnetic field generating portion with respect to the rotational axis direction of the developer rotary member is defined a second magnet area, an average value of a component, in a normal direction of the developer rotary member, of a magnetic flux density of the magnet portion in the second magnet area is greater than an average value of a component, in a normal direction of the developer rotary member, of a magnetic flux density of the magnet portion in the first magnet area by 100 gauss or more.

According to a second aspect of the present invention, a developing apparatus includes a developer rotary member configured to bear and convey developer containing toner and carrier toward a position where an electrostatic image formed on an image bearing member is developed, a magnetic field generating portion arranged to be fixed inside the developer rotary member, comprising a first magnetic pole and a second magnetic pole arranged adjacent to the first magnetic pole downstream of the first magnetic pole with respect to a rotating direction of the developer rotary member and having a same polarity as the first magnetic pole, and configured to generate a magnetic field to release developer, having passed the position where the electrostatic image formed on the image bearing member is developed, from an outer peripheral surface of the developer rotary member, and a magnet portion arranged to oppose to the outer peripheral surface of the developer rotary member at a position downstream of a peak position where a component, in a normal direction of the developer rotary member, of a magnetic flux density of the first magnetic pole becomes maximum and upstream of a peak position where a component, in a normal direction of the developer rotary member, of a magnetic flux density of the second magnetic pole becomes maximum with respect to the rotating direction of the developer rotary member, the magnet portion arranged to be overlapped with an area in which a component, in a normal direction of the developer rotary member, of a magnetic flux density reduces from an end portion of a maximum image area capable of forming an image on the image bearing member toward an outer side with respect to a rotational axis direction of the developer rotary member. A magnetic pole of a surface, on a side opposed to the outer peripheral surface of the developer rotary member in a radial direction of the developer rotary member, of the magnet portion has opposite polarity as the first magnetic pole. The magnet portion is overlapped with an end portion of the magnetic field generating portion with respect to the rotational axis direction of the developer rotary member. In a case where an area of the magnet portion on an inner side from the end portion of the magnetic field generating portion with respect to the rotational axis direction of the developer rotary member is defined a first magnet area and an area of the magnet portion on an outer side from the end portion of the magnetic field generating portion with respect to the rotational axis direction of the developer rotary member is defined a second magnet area, a component, in a normal direction of the developer rotary member, of a magnetic flux density of the magnet portion at a distance of 1 mm from the end portion of the magnetic field generating portion to the outer side with respect to the rotational axis direction of the developer rotary member in the second magnet area is greater than a component, in a normal direction of the developer rotary member, of a magnetic flux density of the magnet portion at a distance of 1 mm from the end portion of the magnetic field generating portion to the inner side with respect to the rotational axis direction of the developer rotary member in the first magnet area by 100 gauss or more.

Further features of the present invention will become apparent from the following description of exemplary embodiments with reference to the attached drawings.

DESCRIPTION OF THE EMBODIMENTS

First Embodiment

Image Forming Apparatus

Figure 1:
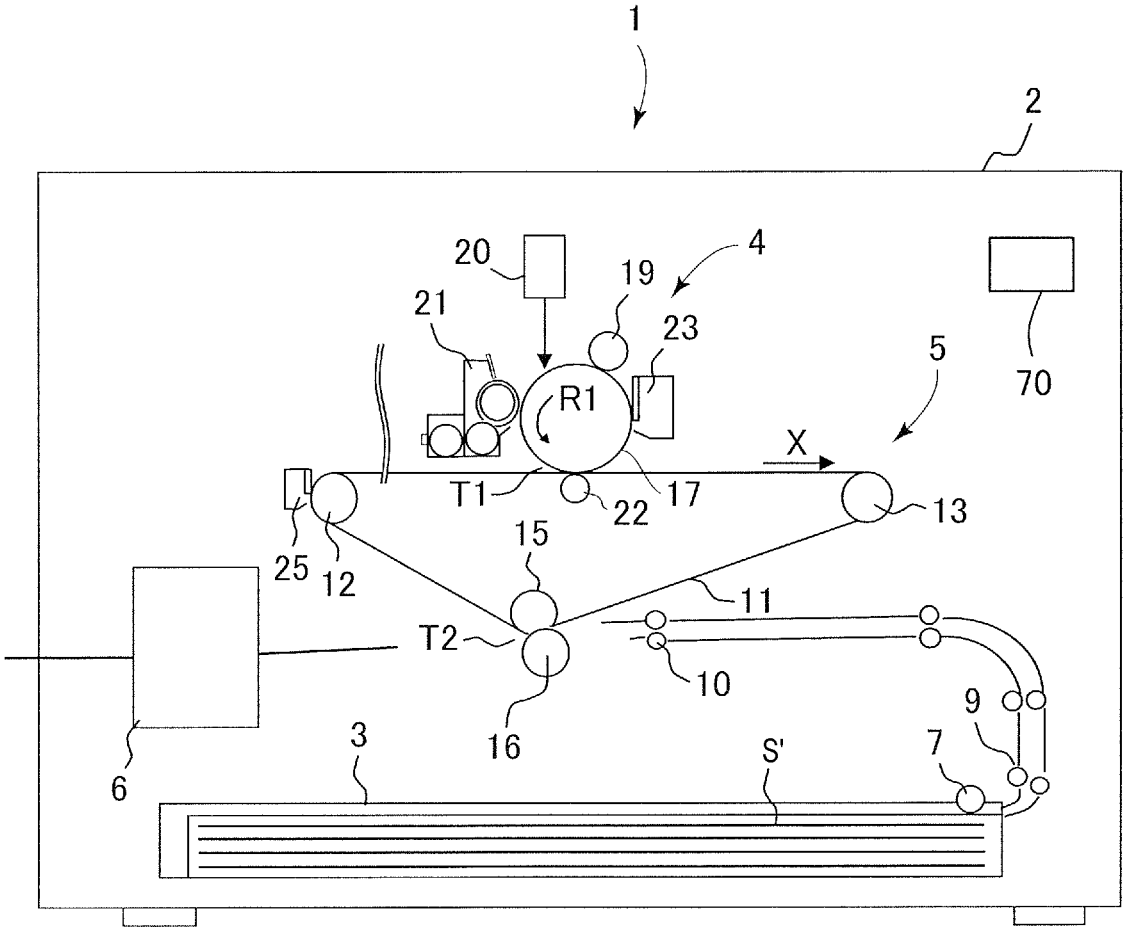
FIG. 1 is a cross-sectional view illustrating a schematic configuration of an image forming apparatus according to a first embodiment.

Now, a first embodiment of the present invention will be described in detail with reference to FIGS. 1 through 5. The present embodiment illustrates a full color printer adopting a digital electrophotographic system as an example of an image forming apparatus 1. However, the present invention is not limited to a printer that adopts a digital electrophotographic system, and it can be an image forming apparatus that adopts other systems. Further, the present invention is not limited to a full-color printer, and it can be a monochrome or mono-color printer. Furthermore, the present invention can be applied to various uses, such as to various printers, copying machines, facsimiles, multifunction devices and so on.

The image forming apparatus 1 is equipped with a sheet cassette 3 serving as a sheet storage portion for storing sheets S' arranged at a lower portion of an apparatus body 2. Further, an image forming unit 5 for forming an image on a sheet S' and a fixing unit 6 for fixing a toner image formed on the sheet are provided on an upper portion of the sheet cassette 3.

The sheet S' supported on the sheet cassette 3 is fed by a pickup roller 7 that constitutes a sheet feeding unit, and thereafter, conveyed by a conveyance roller 9 toward a registration roller 10. Skewing of the sheet S' is corrected by the registration roller 10, and the sheet S' is conveyed to a secondary transfer nip T2 at a matched timing with an image forming timing of the image forming unit 5. A toner image formed by the image forming unit 5 is transferred to the sheet S' at the secondary transfer nip T2. The sheet S' to which unfixed toner image has been transferred is conveyed to the fixing unit 6 and subjected to heat and pressure at the fixing unit 6, by which the toner image is fixed to the sheet S'. Thereafter, the sheet S' is discharged to the sheet discharge tray by a sheet discharge roller not shown.

The image forming unit 5 includes an endless intermediate transfer belt 11 that travels in a belt rotation direction X, and four image forming units 4 respectively forming yellow, magenta, cyan and black toner images and arranged along the intermediate transfer belt 11. In the present embodiment, the four image forming units 4 have similar configurations except for the difference in the colors of the toner being used for developing image, so that in FIG. 1, only one image forming unit 4 is illustrated schematically as representation.

The intermediate transfer belt 11 is stretched across three rollers, which are a drive roller 12, a tension roller 13 and a secondary transfer inner roller 15. Toner images of respective colors formed by the four image forming units 4 are superposed on the intermediate transfer belt 11, and a full-color toner image is formed. At a position opposed to the secondary transfer inner roller 15, a secondary transfer outer roller 16 is arranged with the intermediate transfer belt 11 interposed therebetween, and the secondary transfer nip T2 is formed by the secondary transfer outer roller 16 and the intermediate transfer belt 11.

Each image forming unit 4 is equipped with a photosensitive drum 17 serving as an image bearing member that is a drum-shaped electrophotographic photosensitive member and bears a toner image developed by a developing apparatus 21. The image forming unit 4 is configured by arranging a charge roller 19, an exposing unit 20, a developing apparatus 21, a primary transfer roller 22, a cleaning device 23 and so on around the photosensitive drum 17. The photosensitive drum 17 includes a support shaft (not shown) arranged at a center thereof, and the photosensitive drum 17 is driven to rotate around the support shaft in a rotation direction R1 by a driving unit not shown.

The charge roller 19 is in pressure contact with the surface of the photosensitive drum 17 by predetermined pressing force and driven to rotate along with the rotation of the photosensitive drum 17 in the rotation direction R1. Bias voltage is applied to a core of the charge roller 19 from a charge bias power supply (not shown), by which a surface of the photosensitive drum 17 is charged uniformly to a predetermined potential of predetermined polarity.

In the present embodiment, bias voltage in which DC voltage and AC voltage of 1.5 kVpp are superposed is applied to a core of the charge roller 19. By applying AC voltage, the potential on the photosensitive drum 17 can be converged to a same value as the voltage of the DC voltage. For example, the potential on the surface of the photosensitive drum 17 after being charged is −700 V in a state where the DC voltage is −700 V.

The exposing unit 20 is arranged downstream of the charge roller 19 in the rotation direction R1 of the photosensitive drum 17, and by irradiating laser beams based on image signals, an electrostatic latent image is formed on the photosensitive drum 17. The intensity of laser beam of the exposing unit 20 can be changed within the range of 0 to 255, and by changing the laser beam intensity, the potential, that is, latent image potential, formed on the photosensitive drum 17 is varied. In the present embodiment, latent image potential on the photosensitive drum 17 with the laser beam intensity L varied between "0 to 255" is denoted by V (L).

The developing apparatus 21 is arranged downstream of the exposing unit 20 in the rotation direction R1, and it adopts a two-component image developing system that uses a two-component developer containing nonmagnetic toner and magnetic carrier. The developing apparatus 21 develops the electrostatic latent image formed on the photosensitive drum 17 using toner. In the present embodiment, toner that is charged negatively is used. Here, a weight ratio with which toner and developer that contains toner and carrier is T/D ratio. In the present embodiment, developer which has T/D ratio of 9% is supplied to the developing apparatus 21. A two-component developer is used in the present embodiment, but the present invention is not limited thereto, and for example, a one-component developer can also be used.

The primary transfer roller 22 is arranged downstream of the developing apparatus 21 in the rotational direction R1 and opposed to the photosensitive drum 17 with the intermediate transfer belt 11 interposed therebetween, with both end portions of the primary transfer roller 22 urged toward the photosensitive drum 17 by a pressing member not shown. The photosensitive drum 17 and the intermediate transfer belt 11 form a primary transfer nip T1 where the toner image formed on the photosensitive drum 17 is transferred to the intermediate transfer belt 11. In the present embodiment, the intermediate transfer belt 11 corresponds to an intermediate transfer body on which the toner image transferred from the photosensitive drum 17 is borne.

The cleaning device 23 is arranged downstream of the primary transfer nip T1 in the rotation direction R1 and configured to remove toner remaining on the photosensitive drum 17 at the primary transfer nip T1 by a cleaning blade. The intermediate transfer belt 11 also has a cleaning apparatus 25 that removes toner remaining on the intermediate transfer belt 11 at the secondary transfer nip T2 by a cleaning blade arranged downstream of the secondary transfer nip T2 in the belt rotation direction X.

The apparatus body 2 includes a control unit 70. The control unit 70 is composed of a computer, and for example, it includes a CPU, a ROM for storing programs for controlling various units, a RAM for storing data temporarily, and an input output circuit that inputs and outputs signals to and from the exterior. The CPU is a microprocessor that administers the whole control operation of the image forming apparatus 1, and it is a main subject of a system controller. The CPU is connected to a sheet feeding unit and the image forming unit 5 via the input output circuit and communicates signals with respective units while controlling operation. An image formation control sequence for forming images on sheets S is stored in the ROM.

Figure 2:
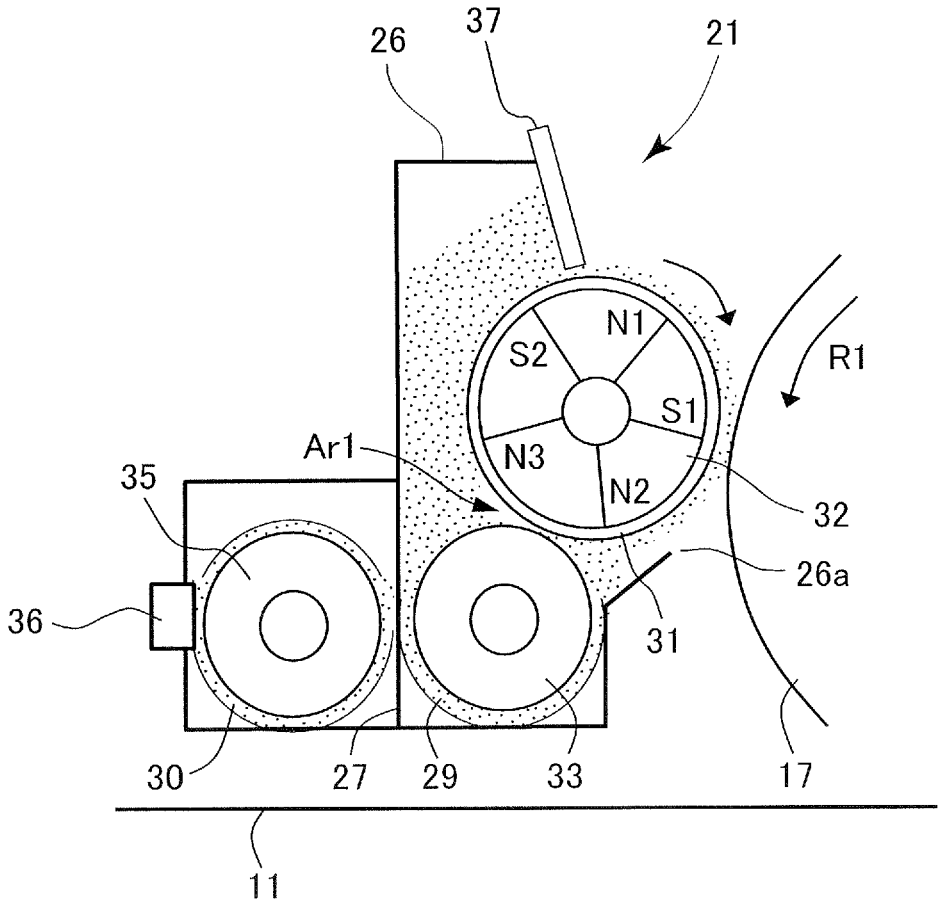
FIG. 2 is a cross-sectional view illustrating a schematic configuration of a developing apparatus of the image forming apparatus according to the first embodiment.
Figure 3:
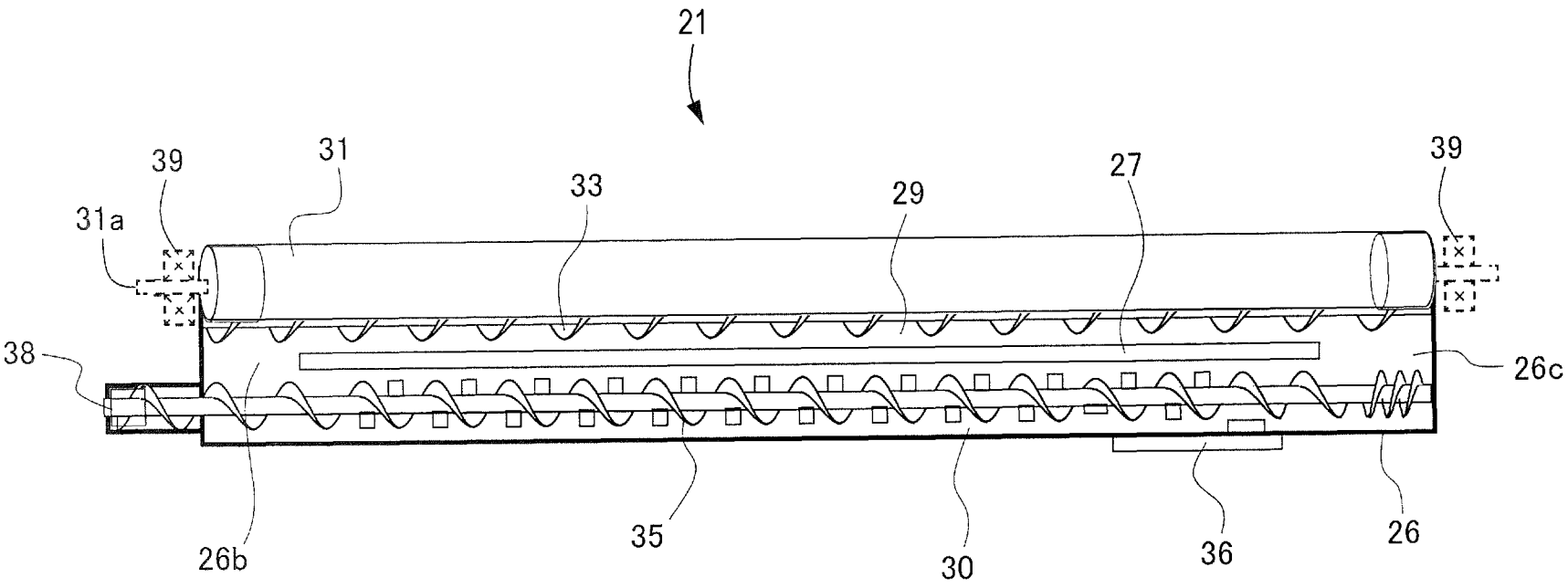
FIG. 3 is a horizontal cross-sectional view illustrating a schematic configuration of the developing apparatus of the image forming apparatus according to the first embodiment.

Next, the developing apparatus 21 will be described with reference to FIGS. 2 and 3. As illustrated in FIGS. 2 and 3, the developing apparatus 21 that adopts a two-component image developing method has a developer container 26 storing developer, the inside of the container divided by a partition wall 27 extending in a perpendicular direction into a developing chamber 29 and an agitating chamber 30. In the developer container 26, a portion of the developing chamber 29 is opened to form an opening portion 26*a*, and a nonmagnetic developing sleeve 31 serving as a developer bearing member is arranged at the opening portion 26*a*. The developing sleeve 31 is an example of a developer rotary member. A portion of the developing sleeve 31 is exposed through the opening portion 26*a* and opposed to the photosensitive drum 17. The developing sleeve 31 rotates while bearing developer in the developer container 26 and conveys the developer to a position opposed to the photosensitive drum 17. The developing sleeve 31 bears and conveys developer toward a position where an electrostatic image formed on the photosensitive drum 17 is developed. Further, a magnet 32 serving as a magnetic field generating portion is fixed in the developing sleeve 31 in a nonrotatable manner with respect to the developer container 26. A magnet roller having a plurality of, such as five, magnetic poles arranged along the rotation direction of the developing sleeve 31 is used as the magnet 32.

A first conveyance screw 33 and a second conveyance screw 35 serving as conveyance members are respectively arranged in the developing chamber 29 and the agitating chamber 30. The first conveyance screw 33, the second conveyance screw 35 and the developing sleeve 31 are mutually drive-coupled by gears not shown, and they are driven to rotate by an image developing drive motor not shown. On the partition wall 27, communicating portions 26*b* and 26*c* (refer to FIG. 3) that allow developer to pass through between the developing chamber 29 and the agitating chamber 30 are formed at both end portions in the rotational axis direction of the developing sleeve 31.

The rotation of the respective conveyance screws 33 and 35 causes developer to be circulated in the developer container 26. More specifically, the rotation of the first conveyance screw 33 in the developing chamber 29 causes developer to be supplied to the developing sleeve 31, and developer whose toner has been consumed by image development and that has reduced toner density is conveyed to the agitating chamber 30. Meanwhile, a developer replenishment port 38 for replenishing developer containing toner into the developing container 26 is provided at an upstream end portion of the agitating chamber 30 in the conveyance direction of the second conveyance screw 35. Developer for replenishment is supplied from a toner bottle not shown through the developer replenishment port 38 to the agitating chamber 30. By rotation of the second conveyance screw 35, toner supplied from the toner bottle not shown and developer already existing in the developer container 26 are agitated and conveyed, and the toner density of developer is uniformized. Then, developer whose toner density has been recovered is supplied to the developing chamber 29. That is, the first conveyance screw 33 and the second conveyance screw 35 rotate to agitate and convey developer in the developer container 26. Further, an inductance sensor 36 is provided on the agitating chamber 30.

As illustrated in FIG. 3, the developing sleeve 31 includes a central axis 31*a* which is supported by a sleeve bearing 39 that supports the developing sleeve 31 rotatably with respect to the developer container 26. The sleeve bearing 39 is provided on the developing apparatus 21. The developing sleeve 31 is composed of a nonmagnetic material such as aluminum and stainless steel. In the present embodiment, a diameter of the developing sleeve 31 is 20 mm, and a diameter of the photosensitive drum 17 is 80 mm. The interval between a developing sleeve 44 and the photosensitive drum 17 at a closest region is set to approximately 300 μm. Thereby, an image can be developed in a state where developer conveyed to the developing area is in contact with the photosensitive drum 17.

The two-component developer agitated by the first conveyance screw 33 in the developing apparatus 21 is constrained by magnetic force of conveyance magnetic pole for draw-up, i.e., draw-up pole, N3 and conveyed by rotation of the developing sleeve 31. Developer is sufficiently constrained by conveyance magnetic pole, i.e., cut pole, S2 having a certain level of magnetic flux density or greater and borne on the developing sleeve 31 while forming a magnetic brush. Thereafter, layer thickness of developer is regulated by cutting the magnetic brush using a regulating blade 37, and the developer with regulated layer thickness is borne by a conveyance magnetic pole N1 and conveyed to the developing area opposed to the photosensitive drum 17 along with the rotation of the developing sleeve 31. Developer forms a magnetic brush by a developing pole S1 at the developing area, and by developing bias applied to the developing sleeve 31 by high voltage power supply (not shown), only toner is transferred to the electrostatic latent image on the photosensitive drum 17, by which a toner image corresponding to the electrostatic latent image is formed on the surface of the photosensitive drum 17.

Among the plurality of magnetic poles of the magnet 32, magnetic pole, i.e., first magnetic pole, N2 and magnetic pole, i.e., second magnetic pole, N3 having the same polarity and arranged in the named order in the rotation direction constitute a release area Ar1 (refer to FIG. 2). The magnetic pole N3 is arranged adjacent to the magnetic pole N2 downstream of the magnetic pole N2 with respect to a direction of rotation of the developing sleeve 31 and having a same polarity as the magnetic pole N2. That is, the release area Ar1 is formed downstream of a peak position where a component, in the normal direction of the developing sleeve 31, of the magnetic flux density at the magnetic pole N2 becomes maximum and on an upstream of a peak position where a component, in the normal direction of the developing sleeve 31, of the magnetic flux density at the magnetic pole N3 becomes maximum with respect to the rotation direction of the developing sleeve 31. The developer having passed through the developing area and having toner consumed by the electrostatic latent image is released from the magnetic constraining force by the magnetic pole at the release area Ar1 between the magnetic poles N2 and N3, released from the surface, i.e., outer peripheral surface, of the developing sleeve 31, and collected in the developing chamber 29. That is, the magnet 32 generates a magnetic field causing developer to be borne on a coating area, i.e., developer borne area, on the surface of the developing sleeve 31, and generates a magnetic field at the release area Ar1 by which developer is released from the developing sleeve 31. The coating area refers to an area in which developer is born on the surface of the developing sleeve 31 to form a thin layer thereon by the magnetic field generated by the magnet 32. The coating area is set to include a maximum image area of the photosensitive drum 17, that is, a maximum area in which the exposing unit 20 can expose the photosensitive drum 17, with respect to the rotational axis direction.

Figure 8:
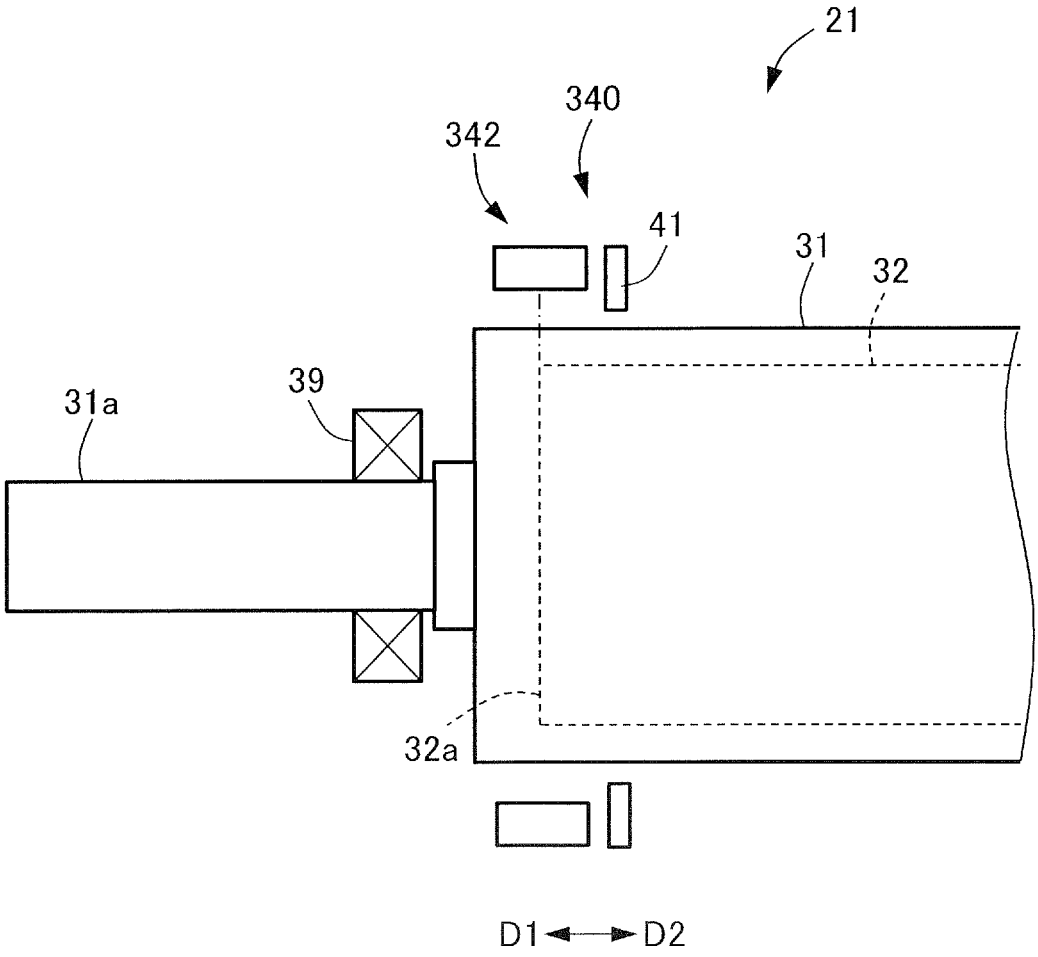
FIG.8 Prior Art
FIG. 8 is a horizontal cross-sectional view illustrating a periphery of an end portion of a developing sleeve in a developing apparatus of an image forming apparatus according to a comparative example.

Next, a magnetic seal portion 340 at an end portion of the developing sleeve 31 will be described with reference to a comparative example of FIG. 8. In the description, a direction from a center side toward an end portion side with respect to the rotational axis direction of the developing sleeve 31 is denoted by outer direction D1, and a direction from the end portion side toward the center side is denoted by an inner direction D2.

In the comparative example, the magnetic seal portion 340 includes a magnetic plate 41 and a magnetic seal member 342. The magnetic plate 41 is arranged at a position opposed to the developing sleeve 31 at the end portion of the developing sleeve 31 and suppresses leakage of developer to the outer direction D1 by the magnetic seal. The magnetic plate 41 is arranged at a position opposed to the magnet 32 via the developing sleeve 31, and is magnetized by the magnetic force generated by the magnet 32 and forms a magnetic brush between the developing sleeve 31 and the magnetic plate 41, by which a magnetic seal effect is exerted.

However, there is little magnetic force of the magnet 32 at the release area Ar1 of the magnet 32, so that the magnetic plate 41 is not magnetized, and sealing performance at the release area cannot be expected. Therefore, as illustrated in the comparative example of FIG. 8, for example, in order to ensure sealing performance at the release area, the magnetic seal member 342 can be provided at a predetermined distance at the outer direction D1 of the magnetic plate 41. The magnetic seal member 342 is a plate-like magnet member, i.e., magnet plate, which is disposed at a position as close as approximately 1 mm in the radial direction of the developing sleeve 31 in a noncontact state along the developing sleeve 31. A magnet plate having an N pole on one side and an S pole on the other side is used as the magnetic seal member 342, and the S pole is arranged toward the developing sleeve 31. In this case, the magnetic seal member 342 forms a line of magnetic force between the magnet 32 and the magnetic seal member 342 with respect to poles N3 and N2 that form a repulsive magnetic field of the magnet 32 of the developing sleeve 31. Thereby, a magnetic brush is formed between the magnet 32 and the magnetic seal member 342 by developer and leakage of developer to the outer direction D1 is suppressed. According to this configuration of the comparative example, leakage of developer to the outer direction D1 from between the magnetic plate 41 and the developing sleeve 31 can be suppressed by forming a magnetic brush by developer between the magnet 32 of the developing sleeve 31 and the magnetic seal member 342.

According to the high-speed image forming apparatus, rotational speed of the photosensitive drum 17 has increased, along with which the rotational speed of the developing sleeve 31 is also increased to realize sufficient image developing efficiency with respect to the photosensitive drum 17 rotating at high speed, so that leakage and scattering of toner tends to occur. In order to suppress leakage and scattering of developer from the end portion of the developing sleeve 31 to the outer direction D1, sealing performance of developer may be improved by increasing the magnetic flux density of the magnetic seal member 342 or by reducing the distance, i.e., shortest distance, between the developing sleeve 31 and the magnetic seal member 342. However, according to the magnetic seal member 342 of the comparative example illustrated in FIG. 8, if the sealing performance of developer is increased, clogging of developer tends to occur. Therefore, a large load is applied from the clogged developer to the developing sleeve 31, which may cause toner to melt and attach to the developing sleeve 31 or cause the developing sleeve 31 to be locked.

Figure 4:
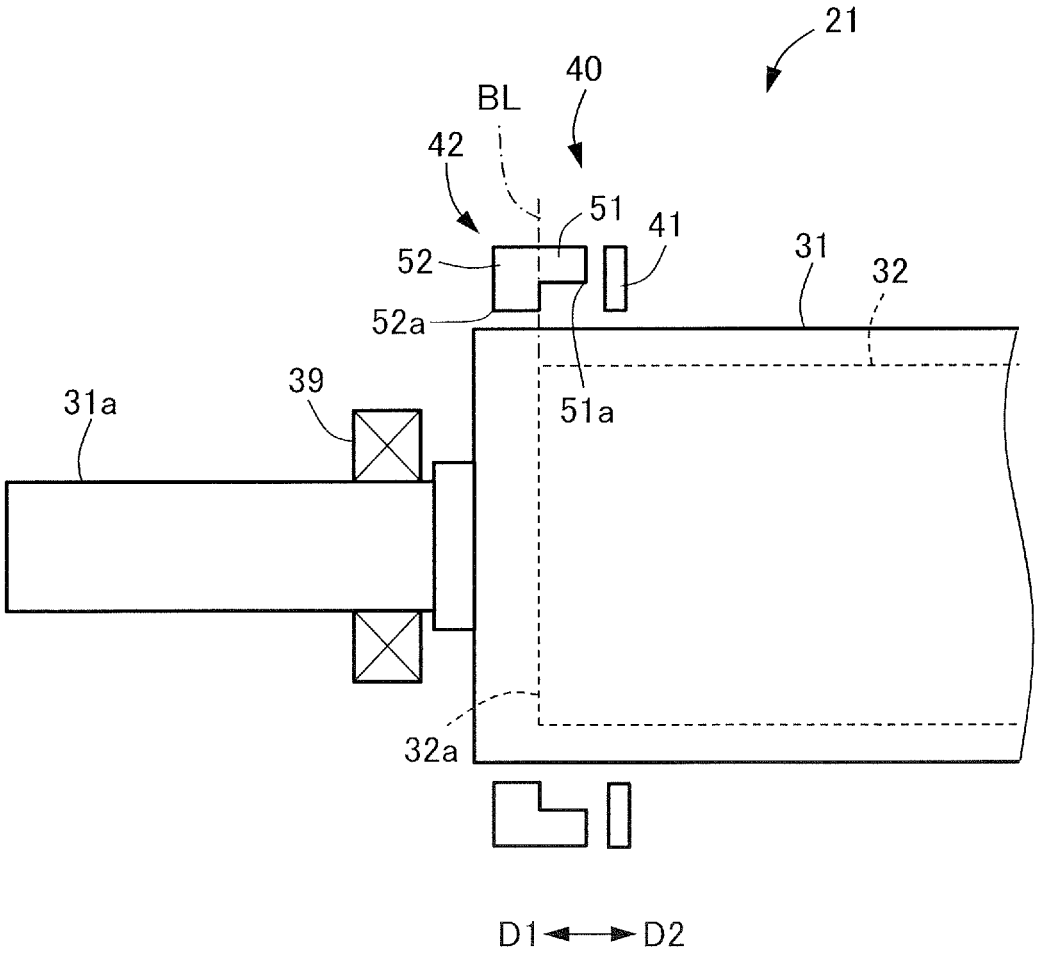
FIG. 4 is a horizontal cross-sectional view illustrating a periphery of an end portion of a developing sleeve in the developing apparatus of the image forming apparatus according to the first embodiment.

Therefore, the present embodiment includes a magnetic seal member 40 as illustrated in FIG. 4. Now, the magnetic seal member 40 according to the present embodiment will be described in detail with reference to FIG. 4. The magnetic seal member 40 includes a magnetic plate, serving as a magnetic member, 41 and a magnetic seal member, serving as a magnet member, 42. The magnetic seal member 42 is an example of a magnet portion. The magnetic plate 41 is arranged at a position opposed to the surface of the developing sleeve 31 in a noncontact manner at the inner direction D2 from the magnetic seal member 42 with respect to the rotational axis direction. The magnetic plate 41 has a similar configuration as the comparative example described above, so that detailed descriptions thereof are omitted.

The magnetic seal member 42 is a plate-like magnetic member serving as a magnet plate similar to the magnetic seal member 342 of the comparative example, and it is positioned at a predetermined distance in the outer direction D1 from the magnetic plate 41 and opposed to a radial direction of the developing sleeve 31 in a noncontact manner along the developing sleeve 31. The magnetic seal member 42 is opposed to the surface of the developing sleeve 31 in a noncontact manner at a vicinity of an end portion 32*a* of the magnet 32 with respect to the rotational axis direction of the developing sleeve 31. Further, a magnet plate having the N pole on a first side and the S pole on a second side is used as the magnetic seal member 42, and the S pole is arranged to face the developing sleeve 31. That is, the magnetic seal member 42 is arranged so that a magnetic pole having an opposite polarity as the magnetic poles N2 and N3 is arranged to face at least the release area Ar1 with respect to the rotation direction.

In the present embodiment, the magnetic seal member 42 is arranged so that a magnetic field formed by the magnetic seal member 42 positioned at the end portion of the developing sleeve 31 and the magnet 32 is set weaker at a portion at the inner direction D2 compared to the portion at the outer direction D1 of the magnetic seal member 42. The magnetic seal member 42 includes a thin portion, serving as a first magnet portion, 51 provided on the inner direction D2 with respect to the rotational axis direction of the developing sleeve 31, and a thick portion, serving as a second magnet portion, 52 provided on an adjacent side opposite to a thin portion 51 with respect to the rotational axis direction. The thin portion 51 is a first magnet area of the magnetic seal member 42 on an inner side in the rotational axis direction than the end portion 32*a* of the magnet 32 with respect to the rotational axis direction of the developing sleeve 31. The thick portion 52 is a second magnet area of the magnetic seal member 42 on an outer side in the rotational axis direction than the end portion 32*a* of the magnet 32 with respect to the rotational axis direction of the developing sleeve 31. A thickness of the thin portion 51 in the radial direction of the developing sleeve 31 is thinner than a thickness of the thick portion 52. The distance between the thin portion 51 and the developing sleeve 31 is longer than the distance between the thick portion 52 and the developing sleeve 31, and a step is formed on the surface of the thin portion 51 and the thick portion 52 opposing to the developing sleeve 31. The shortest distance between the magnetic seal member 42 and the developing sleeve 31 in the thick portion 52 is shorter than the shortest distance between the magnetic seal member 42 and the developing sleeve 31 in the thin portion 51.

A boundary line BL is formed between both ends portions of the magnetic seal member 42 with respect to the rotational axis direction, which in this example is between the thin portion 51 and the thick portion 52. An average magnetic flux density which is an average value of a component, in the normal direction of the developing sleeve 31, of the magnetic flux density of the magnetic seal member 42 at the thin portion 51, which is a portion of the magnetic seal member 42 arranged toward the inner direction D2 from the boundary line BL, is set to be smaller by a predetermined amount or greater than an average magnetic flux density which is the average value of a component, in the normal direction of the developing sleeve 31, of the magnetic flux density of the magnetic seal member 42 at the thick portion 52, which is a portion of the magnetic seal member 42 arranged toward the outer direction D1 from the boundary line BL. That is, in the magnetic seal member 42, the thickness of the area toward the inner direction D2 from the boundary line BL is thinner than the thickness of the area toward the outer direction D1 thereof with respect to the radial direction of the developing sleeve 31. Since the magnetic seal member 42 is a magnet having such a shape, the magnetic flux density of the thick portion 52 becomes stronger than the magnetic flux density of the thin portion 51, and a magnetic field which is weaker at the portion toward the inner direction D2 than at the portion toward the outer direction D1 of the magnetic seal member 42 is formed. The predetermined amount is, for example, 100 gauss, or more preferably, 200 gauss.

The magnetic seal member 42 is arranged so that the end portion 32*a* of the magnet 32 is positioned between a first end portion 51*a* and a second end portion 52*a* with respect to the rotational axis direction. In the present embodiment, the boundary line BL of the magnet seal member 42 is arranged to correspond to the end portion 32*a* of the magnet 32 with respect to the rotational axis direction. Therefore, the thin portion 51 is overlapped with the magnet 32 with respect to the rotational axis direction, and the thick portion 52 is not overlapped. The thin portion 51 is arranged at a distance of approximately 1.0 mm from the developing sleeve 31, and developer is suppressed from being clogged by weakening the magnetic field between the developing sleeve 31 and the magnetic seal member 42. The thick portion 52 is arranged at a distance of approximately 0.5 mm from the developing sleeve 31, and by strengthening the magnetic field between the developing sleeve 31 and the magnetic seal member 42, the leakage of developer to the outer direction D1 is suppressed. The magnetic field at the portion of the outer direction D1 is made stronger than the inner direction D2 of the magnetic seal member 42, by which leakage of developer is suppressed, and the magnetic field at the portion of the inner direction D2 of the magnetic seal member 42 is weakened to suppress clogging of developer.

Figure 5:
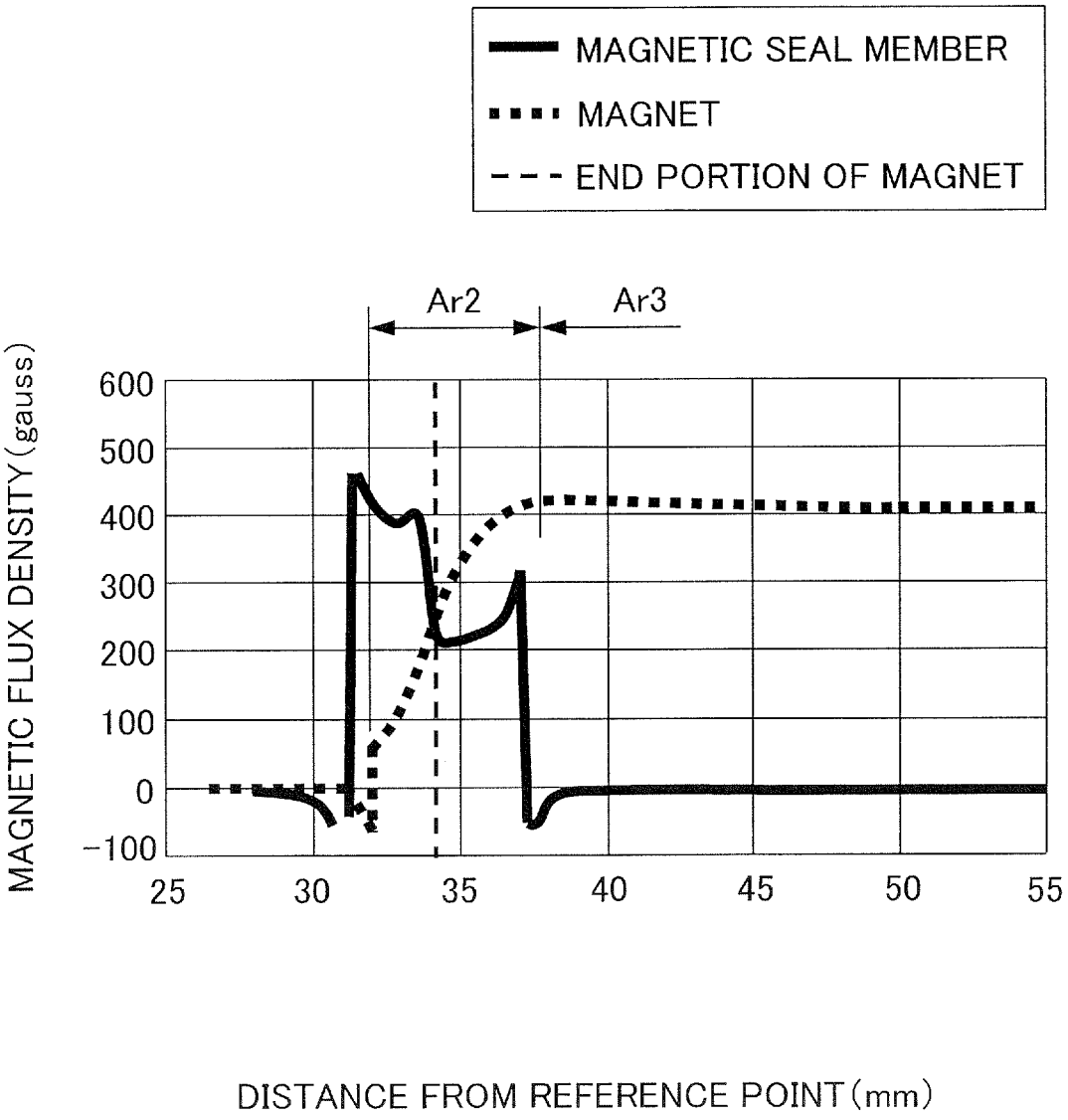
FIG. 5 is a graph illustrating a relationship between magnetic flux density and position of the developing apparatus in a rotational axis direction of the image forming apparatus according to the first embodiment.

The magnetic flux density distribution by the magnet 32 and the magnetic seal member 42 at the end portion in the outer direction D1 on the surface of the developing sleeve 31 at this time is illustrated in FIG. 5. In the drawing of FIG. 5, the magnetic flux density of the magnet 32 illustrates the magnetic flux density at portions excluding the release area Ar1. As illustrated in FIG. 5, the magnetic seal member 42 is arranged to oppose to at least a portion of a change area Ar2 in which the magnetic flux density in the coating area is changed toward approximately 0 with respect to the rotational axis direction. That is, the magnetic seal member 42 is arranged to oppose to at least a portion of the change area Ar2 in which the component, in the normal direction of the developing sleeve 31, of the magnetic flux density is reduced from the end portion on the outer side of an image forming area Ar3 of the developing sleeve 31 corresponding to the maximum image area in which an image can be formed on the photosensitive drum 17 toward the end portion of the developing sleeve 31 on the outer side in the rotational axis direction. Thereby, since the magnetic seal member 42 is arranged at the end portion of the coating area where developer tends to scatter from the surface of the developing sleeve 31, scattering of developer can be suppressed effectively. Especially in the inner direction D2 from the boundary line BL of the magnetic seal member 42, the magnetic field between the developing sleeve 31 and the magnetic seal member 42 is set weak, so that clogging of developer is prevented and locking of the developing sleeve 31 or the attachment of toner is suppressed. In the outer direction D1 from the boundary line BL of the magnetic seal member 42, the magnetic field between the developing sleeve 31 and the magnetic seal member 42 is set strong, so that leakage of developer from the end portion of the developing sleeve 31 to the outer direction D1 is suppressed.

That is, the component, in the normal direction of the developing sleeve 31, of the magnetic flux density of the magnetic seal member 42 at a distance of 1 mm to the outer direction D1 from the boundary line BL is set to be greater than the component, in the normal direction of the developing sleeve 31, of the magnetic flux density of the magnetic seal member 42 at a distance of 1 mm to the inner direction D2 from the boundary line BL by 100 gauss or more (refer to FIG. 5).

In order to further enhance the effect of suppressing both clogging of developer between the developing sleeve 31 and the magnetic seal member 42 and leakage of developer from the end portion of the developing sleeve 31 to the outer direction D1, more preferably, the component, in the normal direction of the developing sleeve 31, of the magnetic flux density of the magnetic seal member 42 at a distance of 1 mm from the boundary line BL to the outer direction D1 is set to be greater than the component, in the normal direction of the developing sleeve 31, of the magnetic flux density of the magnetic seal member 42 at a distance of 1 mm from the boundary line BL to the inner direction D2 by 200 gauss or more (refer to FIG. 5).

The magnetic flux density of the magnetic seal member 42 adopted in the present embodiment and the distance between the developing sleeve 31 and the magnetic seal member 42 are set to satisfy the following expressions 1 and 2. A rotation speed of the developing sleeve 31 is denoted by v, a radius of the developing sleeve 31 is denoted by r, a force of the magnet 32 in the perpendicular direction, i.e., normal direction, received by the developer on the surface of the developing sleeve 31 is denoted by $F_{dr}$, a tangential direction force of the magnet 32 is denoted by $F_{d\theta}$, a force of the magnetic seal member 42 in the perpendicular direction is denoted by $F_{sr}$, and a tangential direction force of the magnetic seal member 42 is denoted by $F_{s\theta}$. Further, a conveyance force of developer in the rotational axis direction is denoted by $F_1$, a weight of developer is denoted by m, a specific heat of developer is denoted by c, a melting temperature of toner is denoted by $T_g$, and room temperature is denoted by T. In the following expression, developer is assumed as a mass, and electrostatic force and intermolecular force acting among toners, among carriers and among toner and carrier is assumed ignorable.

In this case, with respect to the rotational axis direction, the magnetic field of the area overlapped with the magnet 32 of the magnetic seal member 42 is set to satisfy the following expression 1.

$$\mu'(mv^2/r+F_{dr}+mg\sin\theta)v\Delta t\leq mc(T_g-T) \quad \text{Expression 1}$$

Further, with respect to the rotational axis direction, the magnetic field of the area not overlapped with the magnet 32 of the magnetic seal member 42 is set to satisfy the following expression 2.

$$F_1-\mu'(mv^2/r+F_{th}+F_{sr}+mg\sin\theta)<\mu(F_{dr}+F_{sr}+mg\sin\theta) \quad \text{Expression 2}$$

As described earlier, according to the developing apparatus 21 of the present embodiment, the magnetic seal member 42 is at least arranged to oppose to the release area Ar1 with respect to the rotation direction. Further, the magnetic seal member 42 is arranged so that the magnetic field formed by the magnetic seal member 42 disposed at the end portion of the developing sleeve 31 and the magnet 32 is weaker at the inner direction D2 portion than the outer direction D1 portion of the magnetic seal member 42. Therefore, the magnetic field between the developing sleeve 31 and the magnetic seal member 42 is set weaker at the inner direction D2 from the boundary line BL of the magnetic seal member 42, so that the developer is not easily clogged and locking of the developing sleeve 31 and melting of toner is suppressed. In the outer direction D1 from the boundary line BL of the magnetic seal member 42, the magnetic field between the developing sleeve 31 and the magnetic seal member 42 is set stronger, so that the leakage of developer from the end portion of the developing sleeve 31 to the outer direction D1 is suppressed. Therefore, even if the developing sleeve 31 rotates at high speed to cope with increased speed, it can cope with the sudden change of magnetic flux density of the magnet 32 included in the developing sleeve 31 by a simple configuration. Accordingly, both suppression of scattering of toner from the developing sleeve 31 and suppression of attachment of melted toner to the developing sleeve 31 can be realized by providing the magnetic seal member 42 at the end portion of the developing sleeve 31.

According to the present invention, both suppression of toner scattering from the developing sleeve and suppression of adhesion of toner to the developing sleeve can be realized while providing a sealing magnetic member to the end portion of the developing sleeve.

According to the developing apparatus 21 of the present embodiment, the magnetic seal member 42 is arranged so that at least the magnetic pole having an opposite polarity as the magnetic poles N2 and N3 faces the release area Ar1 with respect to the rotation direction. Thereby, lines of magnetic force are formed in a connected manner between the magnet 32 and the magnetic seal member 42, and the sealing performance is improved.

Further according to the developing apparatus 21 of the present embodiment, the magnetic seal member 42 is formed of a magnet in which a thickness at the portion toward the inner direction D2 from the boundary line BL is thinner than the thickness at the portion toward the outer direction D1 thereof with respect to the radial direction of the developing sleeve 31. Therefore, by simply arranging the magnetic seal member 42 along the rotational axis direction, the magnetic seal member 42 can realize a weaker magnetic flux density at the inner direction D2 portion than the magnetic flux density at the outer direction D1 portion of the magnetic seal member 42. Thus, complication of configuration is suppressed, and a simple configuration is realized.

According to the developing apparatus 21 of the present embodiment adopting the magnetic plate 41, a magnetic brush is formed between the developing sleeve 31 and the magnetic plate 41 excluding the release area Ar1, so that a magnetic seal is realized. Therefore, the magnetic seal member 42 should only be provided at least at the release area Ar1, so that the increase of the number of necessary components can be suppressed to a minimum.

The developing apparatus 21 of the present embodiment illustrated above describes a case where the magnetic seal member 42 is arranged with the magnetic pole having an opposite polarity as the magnetic poles N2 and N3 facing the release area Ar1, but the present invention is not limited to this arrangement. For example, the magnetic seal member 42 can be arranged with a magnetic pole having a same polarity as the magnetic poles N2 and N3 at least facing the release area Ar1. In this case, a repulsive magnetic field is formed between the magnet 32 and the magnet serving as the magnetic seal member 42, which enables to keep developer away and suppress leakage.

In this state, the magnetic flux density of the magnetic seal member 42 and the distance between the developing sleeve 31 and the magnetic seal member 42 are set to satisfy the following Expression 3. The rotation speed of the developing sleeve 31 is denoted by v, the radius of the developing sleeve 31 is denoted by r, the force of the magnet 32 in the perpendicular direction received by the developer on the surface of the developing sleeve 31 is denoted by $F_{dr}$, the tangential direction force of the magnet 32 is denoted by $F_{d\theta}$, the force of the magnetic seal member 42 in the perpendicular direction is denoted by $F_{sr}$, and the tangential direction force of the magnetic seal member 42 is denoted by $F_{s\theta}$. Further, conveyance force of developer in the rotational axis direction is denoted by $F_1$, the weight of developer is denoted by m, the specific heat of developer is denoted by c, the melting temperature of toner is denoted by $T_g$, and room temperature is denoted by T. In the following expression, developer is assumed as a mass, and electrostatic force and intermolecular force acting among toners, among carriers and among toner and carrier is assumed ignorable.

With respect to the rotational axis direction, the magnetic field of the area not overlapped with the magnet 32 of the magnetic seal member 42 is set to satisfy the following Expression 3.

$$F_1+F_{d\theta}-\mu'(mv^2/r+F_{dr}+mg\sin\theta)<F_{s\theta}-\mu'(F_{sr}+mg\sin\theta) \quad \text{Expression 3}$$

Further according to the developing apparatus 21 of the present embodiment, a step is formed on the surface of the magnetic seal member 42 facing the developing sleeve 31 so that the distances from the thick portion 52 to the developing sleeve 31 and from the thin portion 51 to the developing sleeve 31 differ, but the present invention is not limited to this example. For example, the surface of the magnetic seal member 42 facing the developing sleeve 31 can be flat, and in that case, a step is formed on a side opposite from the developing sleeve 31. Even according to this example, the thickness of the area toward the inner direction D2 from the boundary line BL is thinner than the thickness of the area toward the outer direction D1 with respect to the radial direction of the developing sleeve 31. Therefore, in the magnetic seal member 42, the magnetic flux density of the thick portion 52 is stronger than the magnetic flux density of the thin portion 51, so that a magnetic field that is weaker at the area toward the inner direction D2 than the area toward the outer direction D1 of the magnetic seal member 42 is formed.

According to the developing apparatus 21 of the present embodiment, the boundary line BL of the magnetic seal member 42 is arranged to match the end portion 32*a* of the magnet 32 with respect to the rotational axis direction, but the present invention is not limited to this example, and the boundary line BL can be deviated therefrom. Further according to the developing apparatus 21 of the present embodiment, the magnetic seal member 42 is arranged so that the end portion position corresponding to the position of the end portion 32*a* of the magnet 32 is positioned between both end portions of the magnetic seal member 42 with respect to the rotational axis direction, but the present invention is not limited to this example. The magnetic seal member 42 should be opposed to at least a portion of the change area Ar2 (refer to FIG. 5) where the magnetic flux density in the coating area changes toward approximately 0, and the end portion position which is the position of the end portion 32*a* of the magnet 32 is not necessarily positioned between both end portions of the magnetic seal member 42. That is, for example, the magnetic seal member 42 can be arranged toward the outer direction D1 or the inner direction D2 from the position of the end portion 32*a* of the magnet 32.

Further, the material of the photosensitive drum 17 and the developer or the configuration of the image forming apparatus 1 and the like adopted in the image forming apparatus 1 of the present embodiment are not limited to those described above, and the present invention can be applied to various developers and image forming apparatuses 1. Specifically, the shape of the magnetic seal member 42, the magnetic flux density, the color or the number of colors of the toner, whether wax is included in the toner, the order in which toners of respective colors are developed, the number of conveyance screws and so on are not limited to those illustrated in the present embodiment, and the present invention is applicable not to other forms of developing apparatuses 21.

Second Embodiment

Figure 6:
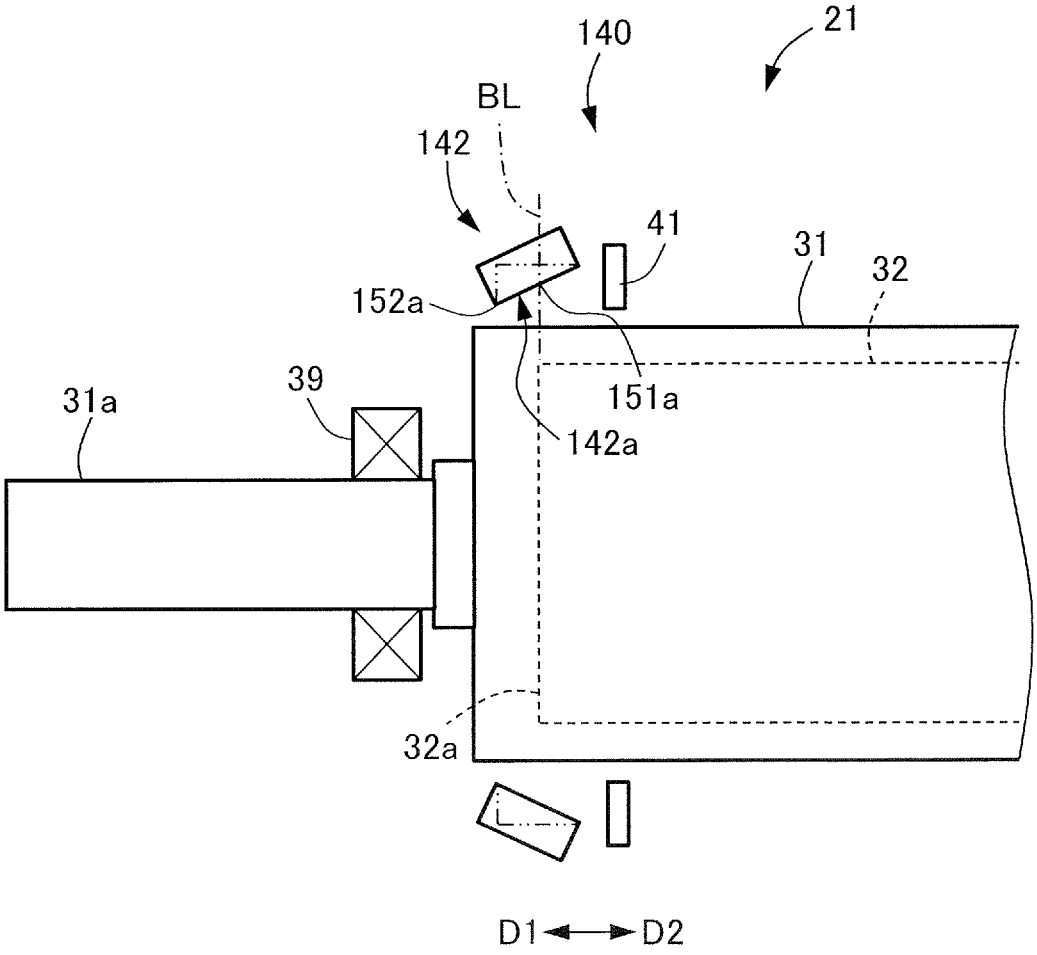
FIG. 6 is a horizontal cross-sectional view illustrating a periphery of an end portion of a developing sleeve in a developing apparatus of an image forming apparatus according to a second embodiment.

Next, a second embodiment of the present invention will be described in detail with reference to FIG. 6. In the present embodiment, a magnetic seal portion 140 includes the magnetic plate 41 and a magnetic seal member 142, and the second embodiment differs from the configuration of the first embodiment in that the magnetic seal member 142 has a plate-like magnet arranged in an inclined manner with respect to the rotational axis direction. The other configurations are similar to the first embodiment, so that they are denoted with the same reference numbers and descriptions thereof are omitted.

In the present embodiment, a plate-like magnet, i.e., magnet plate, is arranged as the magnetic seal member 142 so that it is positioned along the developing sleeve 31 in a noncontact manner and inclined so that the distance between the magnetic seal member 142 and the developing sleeve 31 becomes farther toward the inner direction D2. That is, the magnetic seal member 142 is arranged so that the distance between the magnetic seal member 142 and the developing sleeve 31 is longer at the inner direction D2 portion from the boundary line BL than the outer direction D1 portion. The magnetic seal member 142 adopts a magnet pole having the N pole on one side and the S pole on the other side, and the S pole is positioned to face the developing sleeve 31. The magnetic seal member 142 is arranged so that the magnetic field formed by the magnetic seal member 142 and the magnet 32 becomes stronger at the outer direction D1 than at the inner direction D2 of the magnetic seal member 142 in correspondence with to the sharp change of magnetic flux density at the end portion 32*a* of the magnet 32.

Also according to the present embodiment, a boundary line BL is provided between both end portions of the magnetic seal member 142 with respect to the rotational axis direction. The average magnetic flux density of the portion of the magnetic seal member 142 toward the inner direction D2 from the boundary line BL is set to be smaller by a predetermined amount or greater than the average magnetic flux density of the portion of the magnetic seal member 142 toward the outer direction D1 from the boundary line BL. The boundary line BL is set to correspond to the end portion 32*a* of the magnet 32 of the magnetic seal member 142 with respect to the rotational axis direction.

Specifically, a first distance between the developing sleeve 31 and a first end portion 151*a* which is a closest portion between the developing sleeve 31 and the magnetic seal member 142 in an area where the magnet 32 and the magnetic seal member 142 are overlapped is set to approximately 1.0 mm. Further, a second distance between the developing sleeve 31 and a second end portion 152*a* which is a closest portion between the developing sleeve 31 and the magnetic seal member 142 in an area where the magnetic seal member 142 is not overlapped with the magnet 32 is set to approximately 0.5 mm. In this case, the magnetic seal member 142 has an inclined surface 142*a* where the first distance is longer than the second distance on the plane opposed to the developing sleeve 31.

According to this configuration, the distance between the developing sleeve 31 and the magnetic seal member 142 in the area where the magnet 32 and the magnetic seal member 142 are overlapped is approximately 1.0 mm or greater. Therefore, the magnetic field between the developing sleeve 31 and the magnetic seal member 142 is weakened at the inner direction D2 portion of the magnetic seal member 142, so that clogging of developer can be suppressed. Meanwhile, in the area of the magnetic seal member 142 not overlapped with the magnet 32, the distance between the developing sleeve 31 and the magnetic seal member 142 becomes as close as approximately 0.5 mm. Therefore, at the outer direction D1 portion of the magnetic seal member 142, the magnetic field between the developing sleeve 31 and the magnetic seal member 142 is made strong, so that leakage of developer can be suppressed. According further to the present embodiment, the distance between the magnetic seal member 142 and the developing sleeve 31 and the magnetic flux density are set to satisfy the above-described Expressions 1 and 2.

As described, also according to the developing apparatus 21 of the present embodiment, the following effects are exerted. The magnetic field between the developing sleeve 31 and the magnetic seal member 142 is set weak at the inner direction D2 of the magnetic seal member 142 from the boundary line BL, so that the clogging of developer can be suppressed and locking of the developing sleeve 31 or adhesion of toner thereto can be suppressed. Further, the magnetic field between the developing sleeve 31 and the magnetic seal member 142 is set strong at the outer direction D1 of the magnetic seal member 142 from the boundary line BL, so that leakage of developer from the end portion of the developing sleeve 31 to the outer direction D1 can be suppressed.

The developing apparatus 21 of the present embodiment has been described based on a case where the magnet plate serving as the magnetic seal member 142 is arranged in an inclined manner with respect to the rotational axis direction, but the shape of the magnetic seal member 142 is not limited thereto. For example, the shape of the magnetic seal member 142 can have a triangular cross-sectional shape where the area on the inner direction D2 is thinned, as illustrated by an imaginary line in FIG. 6. Even according to this case, the distance between the magnetic seal member 142 and the developing sleeve 31 at the portion toward the inner direction D2 from the boundary line BL is set longer than the distance between the magnetic seal member 142 and the developing sleeve 31 at the portion toward the outer direction D1. Therefore, the magnetic field at the outer direction D1 is set stronger than the inner direction D2 of the magnetic seal member 142, so that leakage of developer can be suppressed, and the magnetic field at the inner direction D2 of the magnetic seal member 142 is set weak so that clogging of developer can be suppressed.

Third Embodiment

Figure 7:
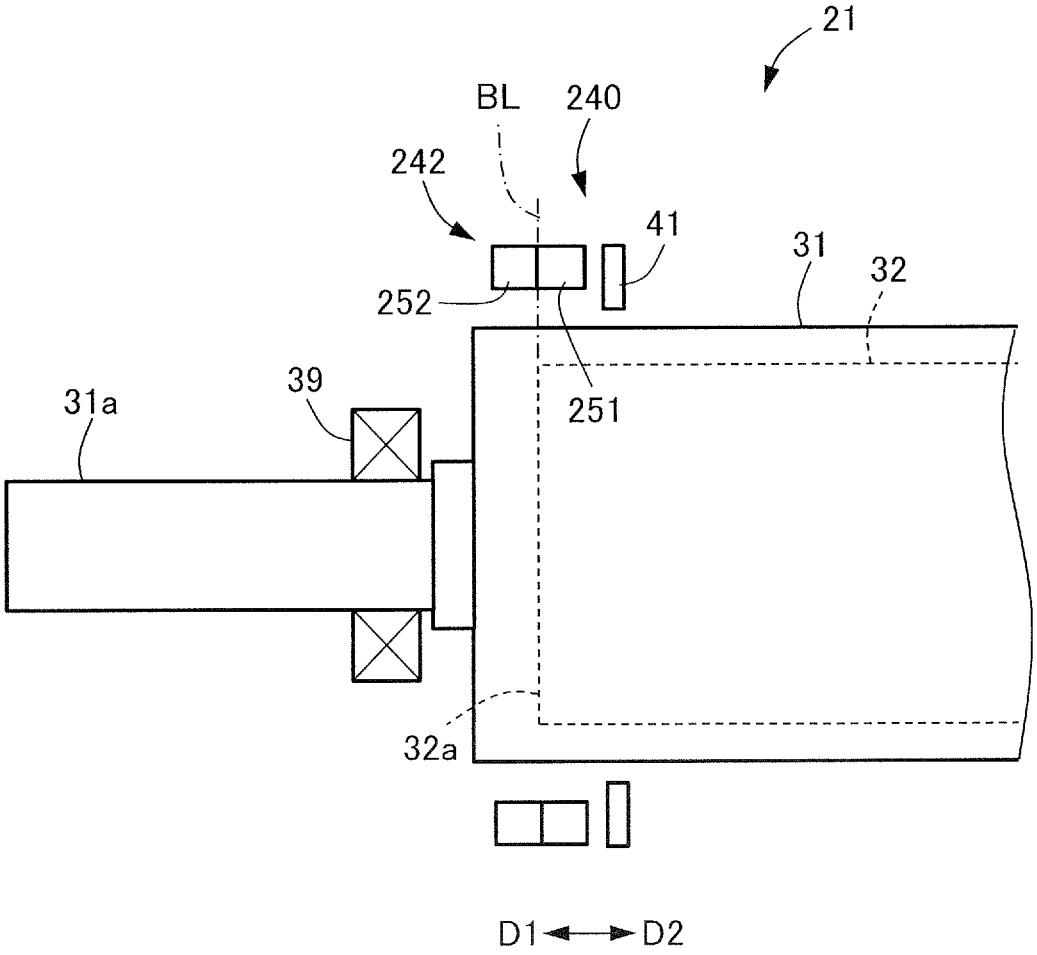
FIG. 7 is a horizontal cross-sectional view illustrating a periphery of an end portion of a developing sleeve in a developing apparatus of an image forming apparatus according to a third embodiment.

Next, a third embodiment of the present invention will be described in detail with reference to FIG. 7. In the present embodiment, a magnetic seal portion 240 includes the magnetic plate 41 and a magnetic seal member 242, and the third embodiment differs from the configuration of the first embodiment in that the magnetic seal member 242 has a first magnet portion 251 and a second magnet portion 252 that are arranged adjacently in the rotational axis direction. The other configurations are similar to the first embodiment, so that they are denoted with the same reference numbers and descriptions thereof are omitted.

The thickness of the first magnet portion 251 is the same as the thickness of the second magnet portion 252 with respect to the radial direction of the developing sleeve 31. According further to the present embodiment, a boundary line BL is provided between both end portions of the magnetic seal member 242 with respect to the rotational axis direction, which in the present embodiment is between the first magnet portion 251 and the second magnet portion 252. The first magnet portion 251 is provided on the inner direction D2 from the boundary line BL and has a first average magnetic flux density. The second magnet portion 252 is provided on the outer direction D1 from the boundary line BL and has a second average magnetic flux density which is greater than the first average magnetic flux density. Thereby, the average magnetic flux density of the portion of the magnetic seal member 242 on the inner direction D2 from the boundary line BL is set smaller by a predetermined amount or greater than the average magnetic flux density of the portion of the magnetic seal member 242 on the outer direction D1 from the boundary line BL. The boundary line BL is set to correspond to the end portion 32*a* of the magnet 32 of the magnet seal member 242 with respect to the rotational axis direction.

Further, the magnetic seal member 242 has an N pole on one side and an S pole on the other side, and the S pole is arranged to face the developing sleeve 31. The magnetic seal member 242 is arranged so that the magnetic field formed by the magnetic seal member 242 and the magnet 32 becomes stronger at the outer direction D1 than at the inner direction D2 of the magnetic seal member 242 to correspond to the sharp change of magnetic flux density at the end portion 32*a* of the magnet 32. The distance between the developing sleeve 31 and the magnetic seal member 242 is set to approximately 1.0 mm.

Specifically, a magnet having a small magnetic flux density, such as a ferrite magnet, is adopted as the first magnet portion 251 in the area where the magnet 32 and the magnetic seal member 242 are overlapped. Thereby, the magnetic field between the developing sleeve 31 and the magnetic seal member 242 can be weakened so that clogging of developer can be suppressed. Meanwhile, a magnet having a great magnetic flux density, such as a neodymium magnet, is adopted as the second magnet portion 252 in the area where the magnetic seal member 242 is not overlapped with the magnet 32. Thereby, the magnetic field between the developing sleeve 31 and the magnetic seal member 242 can be made strong so that the leakage of developer can be suppressed.

As described above, also according to the developing apparatus 21 of the present embodiment, the following effects are exerted. The magnetic field between the developing sleeve 31 and the magnetic seal member 242 is set weak at the inner direction D2 of the magnetic seal member 242 from the boundary line BL, so that the clogging of developer can be suppressed and locking or adhesion of toner to the developing sleeve 31 can be suppressed. Further, the magnetic field between the developing sleeve 31 and the magnetic seal member 242 is set strong at the outer direction D1 of the magnetic seal member 242 from the boundary line BL, so that leakage of developer from the end portion of the developing sleeve 31 to the outer direction D1 can be suppressed.

The present embodiment adopts a configuration where two kinds of magnets formed of different materials are used to form one magnetic seal member 242, but the present invention is not limited to using two kinds of magnets, and three or more kinds of magnets formed of different materials can be used. Moreover, the present invention is not limited to using different kinds of magnets to realize different magnetic flux densities, and the same kind of magnet can be used but with a varied material density to realize different magnetic flux densities between the outer direction D1 and the inner direction D2 of the magnetic seal member 242.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-156344, filed Aug. 23, 2018, which is hereby incorporated by reference herein in its entirety.

What is claimed is:

1. A developing apparatus comprising:

a developer rotary member configured to bear and convey developer containing toner and carrier toward a position where an electrostatic image formed on an image bearing member is developed;

a magnetic field generating portion arranged to be fixed inside the developer rotary member, comprising a first magnetic pole and a second magnetic pole arranged adjacent to the first magnetic pole downstream of the first magnetic pole with respect to a rotating direction of the developer rotary member and having a same polarity as the first magnetic pole, and configured to generate a magnetic field to release developer, having passed the position where the electrostatic image formed on the image bearing member is developed, from an outer peripheral surface of the developer rotary member; and a magnet portion arranged to oppose the outer peripheral surface of the developer rotary member at a position downstream of a peak position where a component, in a normal direction of the developer rotary member, of a magnetic flux density of the first magnetic pole becomes maximum and upstream of a peak position where a component, in a normal direction of the developer rotary member, of a magnetic flux density of the second magnetic pole becomes maximum with respect to the rotating direction of the developer rotary member, the magnet portion arranged to be overlapped with an area in which a component, in a normal direction of the developer rotary member, of a magnetic flux density reduces from an end portion of a maximum image area capable of forming an image on the image bearing member toward an outer side with respect to a rotational axis direction of the developer rotary member, wherein a magnetic pole of a surface, on a side opposed to the outer peripheral surface of the developer rotary member in a radial direction of the developer rotary member, of the magnet portion has opposite polarity as the first magnetic pole, wherein the magnet portion is overlapped with an end portion of the magnetic field generating portion with respect to the rotational axis direction of the developer rotary member, and wherein in a case where an area of the magnet portion on an inner side from the end portion of the magnetic field generating portion with respect to the rotational axis direction of the developer rotary member is defined a first magnet area and an area of the magnet portion on an outer side from the end portion of the magnetic field generating portion with respect to the rotational axis direction of the developer rotary member is defined a second magnet area, an average value of a component, in a normal direction of the developer rotary member, of a magnetic flux density of the magnet portion in the second magnet area is greater than an average value of a component, in a normal direction of the developer rotary member, of a magnetic flux density of the magnet portion in the first magnet area by 100 gauss or more.

2. The developing apparatus according to claim 1, wherein the average value of the component, in the normal direction of the developer rotary member, of the magnetic flux density of the magnet portion in the second magnet area is greater than an average value of the component, in the normal direction of the developer rotary member, of the magnetic flux density of the magnet portion in the first magnet area by 200 gauss or more.

3. The developing apparatus according to claim 1, wherein a shortest distance between the magnet portion and the developer rotary member in the second magnet area is shorter than a shortest distance between the magnet portion and the developer rotary member in the first magnet area.

4. The developing apparatus according to claim 1, wherein a thickness of the magnet portion in a radial direction of the developer rotary member in the second magnet area is thicker than a thickness of the magnet portion in the radial direction of the developer rotary member in the first magnet area.

5. A developing apparatus comprising:

a developer rotary member configured to bear and convey developer containing toner and carrier toward a position where an electrostatic image formed on an image bearing member is developed;

a magnetic field generating portion arranged to be fixed inside the developer rotary member, comprising a first magnetic pole and a second magnetic pole arranged adjacent to the first magnetic pole downstream of the first magnetic pole with respect to a rotating direction of the developer rotary member and having a same polarity as the first magnetic pole, and configured to generate a magnetic field to release developer, having passed the position where the electrostatic image formed on the image bearing member is developed, from an outer peripheral surface of the developer rotary member; and a magnet portion arranged to oppose the outer peripheral surface of the developer rotary member at a position downstream of a peak position where a component, in a normal direction of the developer rotary member, of a magnetic flux density of the first magnetic pole becomes maximum and upstream of a peak position where a component, in a normal direction of the developer rotary member, of a magnetic flux density of the second magnetic pole becomes maximum with respect to the rotating direction of the developer rotary member, the magnet portion arranged to be overlapped with an area in which a component, in a normal direction of the developer rotary member, of a magnetic flux density reduces from an end portion of a maximum image area capable of forming an image on the image bearing member toward an outer side with respect to a rotational axis direction of the developer rotary member, wherein a magnetic pole of a surface, on a side opposed to the outer peripheral surface of the developer rotary member in a radial direction of the developer rotary member, of the magnet portion has opposite polarity as the first magnetic pole, wherein the magnet portion is overlapped with an end portion of the magnetic field generating portion with respect to the rotational axis direction of the developer rotary member, and wherein in a case where an area of the magnet portion on an inner side from the end portion of the magnetic field generating portion with respect to the rotational axis direction of the developer rotary member is defined a first magnet area and an area of the magnet portion on an outer side from the end portion of the magnetic field generating portion with respect to the rotational axis direction of the developer rotary member is defined a second magnet area, a component, in a normal direction of the developer rotary member, of a magnetic flux density of the magnet portion at a distance of 1 mm from the end portion of the magnetic field generating portion to the outer side with respect to the rotational axis direction of the developer rotary member in the second magnet area is greater than a component, in a normal direction of the developer rotary member, of a magnetic flux density of the magnet portion at a distance of 1 mm from the end portion of the magnetic field generating portion to the inner side with respect to the rotational axis direction of the developer rotary member in the first magnet area by 100 gauss or more.

6. The developing apparatus according to claim 5, wherein the component, in the normal direction of the developer rotary member, of the magnetic flux density of the magnet portion at the distance of 1 mm from the end portion of the magnetic field generating portion to the outer side with respect to the rotational axis direction of the developer rotary member in the second magnet area is greater than the component, in the normal direction of the developer rotary member, of the magnetic flux density of the magnet portion at the distance of 1 mm from the end portion of the magnetic field generating portion to the inner side with respect to the rotational axis direction of the developer rotary member in the first magnet area by 200 gauss or more.

7. The developing apparatus according to claim 5, wherein a shortest distance between the magnet portion and the developer rotary member in the second magnet area is shorter than a shortest distance between the magnet portion and the developer rotary member in the first magnet area.

8. The developing apparatus according to claim 5, wherein a thickness of the magnet portion in a radial direction of the developer rotary member in the second magnet area is thicker than a thickness of the magnet portion in the radial direction of the developer rotary member in the first magnet area.

* * * * *